United States Patent [19]

Nozue

[11] Patent Number: 4,594,932

[45] Date of Patent: Jun. 17, 1986

[54] PIANO PLATE MOUNTING STRUCTURE FOR UPRIGHT PIANO

[75] Inventor: Fusao Nozue, Shizuoka, Japan

[73] Assignee: Nippon Gakki Seizo Kabushiki Kaisha, Japan

[21] Appl. No.: 633,865

[22] Filed: Jul. 24, 1984

[30] Foreign Application Priority Data

Jul. 27, 1983 [JP] Japan ..... 58-137068

[51] Int. Cl.[4] ..... G10C 3/04

[52] U.S. Cl. ..... 84/185; 84/431

[58] Field of Search ..... 84/184, 185, 188, 187, 84/250, 431

[56] References Cited

U.S. PATENT DOCUMENTS

| | | | |
|---|---|---|---|
| 844,985 | 2/1907 | Wuest, Jr. | 84/188 X |
| 896,066 | 8/1908 | Sander | 84/250 |
| 2,505,804 | 5/1950 | Stein | 84/185 X |
| 4,376,402 | 3/1983 | Helpinstill | 84/431 X |

*Primary Examiner*—L. T. Hix
*Assistant Examiner*—Brian W. Brown
*Attorney, Agent, or Firm*—Lerner, David, Littenberg, Krumholz & Mentlik

[57] ABSTRACT

In construction of a piano plate for an upright piano, connectors partly embedded in one body therewith serve for direct mounting of the keyboard assembly, the side boards and the action assemblies so that three closely related elements of the upright piano, i.e. the action and keyboard assemblies and the strings, should collectively relate in construction to the piano plate for their easy and accurate relative setting and adjustment in position. Undesirable influence by warp of the conventionally used back posts and hard and troublesome mechanical work in production are both totally removed.

6 Claims, 10 Drawing Figures

PIANO PLATE MOUNTING STRUCTURE FOR UPRIGHT PIANO

BACKGROUND OF THE INVENTION

The present invention relates to improved piano plate mounting structure for an upright piano, and more particularly relates to an improved construction of a piano plate in relation to the associated action assemblies, side boards and keyboard assemblies on an upright piano.

In the construction of a conventional upright piano, its action bracket for action assemblies is coupled to a pin block on back posts and placed on a key bed. A keyboard assembly is also mounted to the key bed which is coupled to side boards by assistance of side arms. The side boards are supported by the back posts. Strings to be operated by the keyboard and action assemblies are all arranged on a metallic piano plate. In other words, among the three closely related members, the keyboard and action assemblies are placed under influence by behavior of back post and the strings are placed out of such an influence. Since back posts are usually made of woods, they are rather susceptible to changes in environmental factors such as temperature and humidity. Once any warp develops on the back posts due to such changes, it is liable to cause corresponding disorder in position of the keyboard and action assemblies relative to the strings on the piano plate which is usually made of metal and in general impervious to such emvironmental changes. This fact makes it very difficult to properly carry out dimensional setting and adjustment of these three closely related elements on the upright piano.

In addition, the piano plate is provided with a number of threaded holes for combination with related elements of the upright piano by assistance of set bolts. Since the piano plate is usually produced by casting, such threaded holes have to be formed by tapping or boring after casting. Hard texture in the surface region of such cast piano plate disenables easy and smooth formation of such threaded holes, thereby seriously lowering productivity of the piano plate and promoted fatique of cutters used for tapping and boring. Further, the heavy and unwieldy construction of the metallic piano plate requires hard work in its setting for these mechanical operations with use of lots of jigs.

SUMMARY OF THE INVENTION

It is the primary object of the present invention to enable easy dimensional setting and adjustment of the three closely related elements on an upright piano, i.e. keyboard and action assemblies and strings, with high accuracy, for correct generation of musical tones.

It is another object of the present invention to release the three closely related elements on an upright piano, i.e. keyboard and action assemblies and string, from ill influence caused by use of back posts.

It is the other object of the present invention to produce a piano plate mounting structure for an upright piano with high productivity and less labour.

In accordance with the basic aspect of the present invention, a piano plate is provided with two or more connectors for mounting an action bracket thereon.

In accordance with a preferred embodiment of the present invention, side boards are coupled at the mounting seats on the connectors to the piano plate.

In accordance with another preferred embodiment of the present invention, the piano plate is further provided with side shafts and a keyboard unit including a keyboard assembly, side arms and a key bed is pivoted at its rear end to the side shaft.

In accordance with the preferred embodiment of the present invention, a piano plate of cast material includes connectors embedded therein in the form of inserts during casting of the piano plate and which are adapted for coupling at least one action bracket of the upright piano to the piano plate.

DESCRIPTION OF THE PREFERRED EMBODIMENTS

Figure 1:
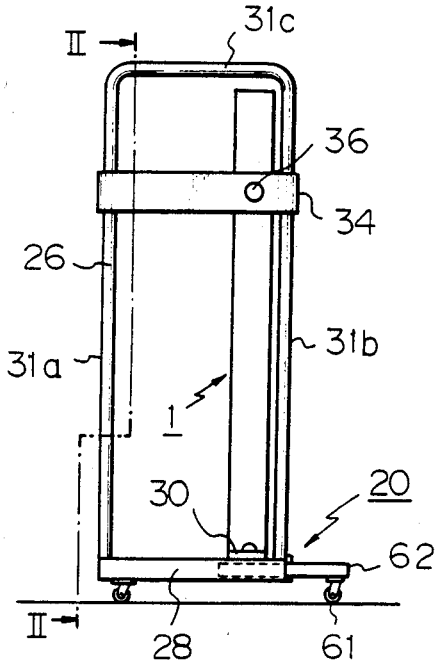
FIG. 1. is a side view of one embodiment of the piano plate in accordance with the present invention.
Figure 2:
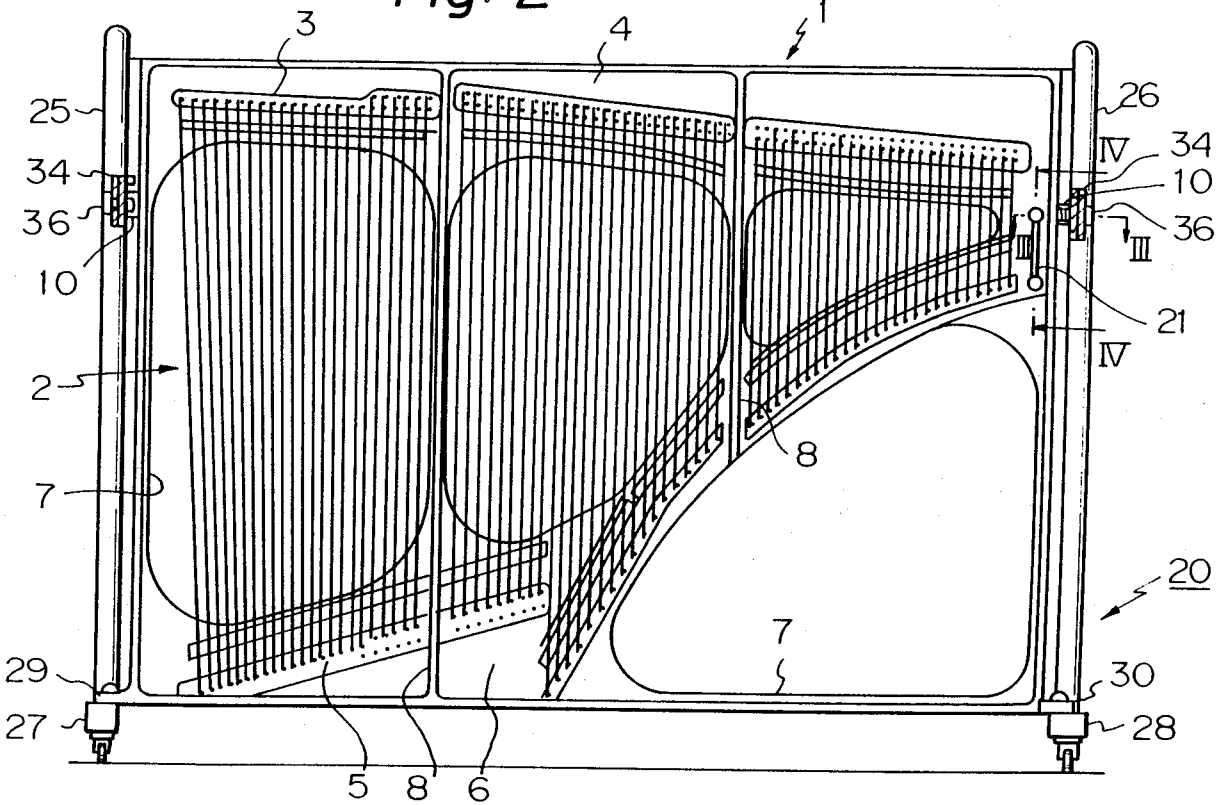
FIG. 2 is a section taken along a line II—II in FIG. 1 for showing a combination of the piano plate with a plate holder unit via a connector.

An embodiment of the piano plate used for an upright piano in accordance with the present invention is shown in FIGS. 1 and 2, in which a piano plate 1 is made by casting of aluminium alloy or cast iron in one body with later-described connectors. The piano plate 1 has a picture frame like configuration with its peripheral sections projecting forwards. Lots of tuning pins 3 are secured at bottoms in the piano plate 1 near its upper peripheral edge in order to hold the upper ends of string 2. The tuning pins 3 form a tuning pin section 4 which extends over the entire tonal range in the transverse direction of the piano plate 1. Further, lots of hitch pins 5 are secured at bottoms in the piano plate 1 near its lower peripheral edge in order to hold the lower ends of the strings 2. The hitch pins 5 form a hitch pin section 6 which extends over the entire tonal range in the transverse direction of the piano plate 1. Thus, the strings 2 are held in tension between the two sections 4 and 5.

Several cutouts 7 are formed in the piano plate 1 for reduction in weight and several ribs 8 span in the vertical direction for reinforcement. Near the upper ends of the side peripheral edges, connectors 10 are arranged on the piano plate 1 in order to secure the piano plate 1 to a later described plate holder unit 20 and to secure action brackets 21 to the piano plate 1.

Figure 3:
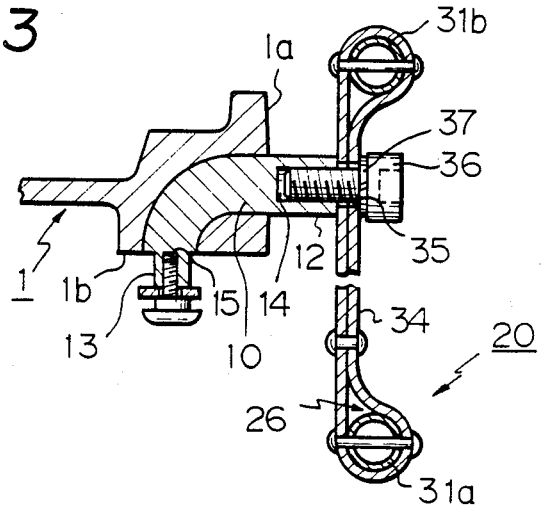
FIG. 3 is a top plan view of the plate holder unit and the piano plate in the assembled state.

At casting of the piano plate 1, the connectors 10 are placed in position in the mould as inserts and are cast together. Thus, each connector 10 is partly embedded in the associated section of the piano plate 1 as best seen in FIG. 3. The connector 10 takes the form of an L-shaped rod with its ends being exposed outside the piano plate whilst forming mounting seats 12 and 13 which projects from the side and front faces 1*a* and 1*b* of the piano plate 1 respectively. The mounting seats 12 and 13 have threaded holes 14 and 15 opening in their distal ends. These threaded holes 14 and 15 are formed by tapping before the connector 10 is placed as an insert in the mould at casting. The material for the connector 10 should be higher in melting point than that for the piano plate 1.

The construction of the plate holder unit 20 is best seen in FIGS. 1 and 3, in which the plate holder unit 20 takes the form of a substantially rectangular solid skelton. More specifically, it includes a pair of side posts 25 and 26 and a pair of toe blocks 27 and 28 on which the side posts 25 and 26 are constructed. Mounting seats 29 and 30 are formed in one body with respective lower corners of the piano plate 1 and securedly placed on the respective toe blocks 27 and 28 via proper spacers (not shown).

Each side post 25 or 26 is comprised of front and rear vertical sections 31*a* and 31*b*, and an upper horizontal section 31*c* for connecting the upper ends of the vertical sections 31*a* and 31*b*. Near the upper ends, the vertical sections 31*a* and 31*b* are connected one another by a thin steel strap 34. The level of the steel straps 34 on the plate holder unit 20 corresponds to that of the connectors 10 on the piano plate 1. At a position corresponding to that of the threaded hole 14 in the connector 10 (see FIG. 3), a through hole 35 is made in the steel strap 34 so that a set bolt 36 may be inserted, sandwiching a washer 37, idly through the hole 35 for screw engagement with the threaded hole 14 in the connector 10. The piano plate 1 is thus securedly mounted to the plate holder unit 20.

Figure 4:
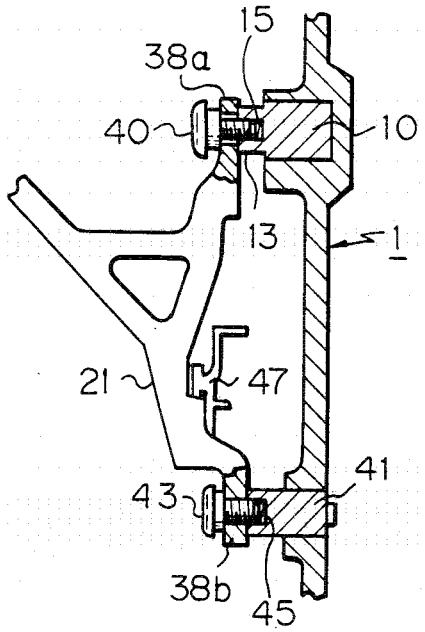
FIG. 4 is a section taken along a line IV—IV in FIG. 2 for showing a combination of the piano plate with an action bracket via connectors.

Mounting of the action bracket 21 to the piano plate 1 is shown in detail in FIG. 4, in which the action bracket 21 has two mounting seats 38*a* and 38*b*. The upper mounting seat 38*a* is secured to the mounting seat 13 of one connector 10 on the piano plate 1 by means of the set bolt 40 screwed into the threaded hole 15. Whereas the lower mounting seat 38*b* is secured to a mounting seat of another connector 41 on the piano plate 1 by means of a set bolt 43 screwed into a threaded hole 45.

The connector 41 is basically same in construction as the connector 10 and formed by casting in one body with the piano plate 1. The mounting seat projects from the piano plate 1 and the threaded hole 45 opens in its distal end.

The action bracket 21 horizontally carries a center rail 47 for mounting of a known action assembly. Further, the toe blocks 27 and 28 are open rearwards for telescopic insertion of auxiliary toe blocks 62 accompanied with casters 61.

Figure 5:
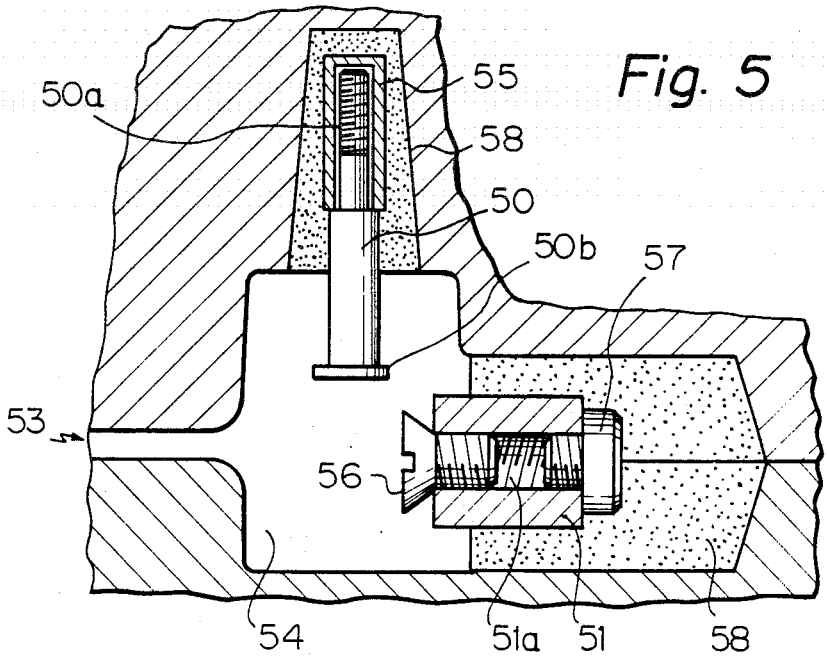
FIG. 5 is a sectional view of one example of a mould used for production of the piano plate in accordance with the present invention.

FIG. 5 shows a mould usable for production of the piano plate in accordance with the present invention. In the example illustrated, a connector 50 having a male screw 50*a* and a connector 51 having a female screw 51*a* are attached, as inserts, to insert holding sections 54 of a mould 53. The connector 50 is provided with a brim 50*b* on its end to be embedded in the piano plate by casting for tighter combination with the piano plate, and a cap 55 is inserted over the male screw 50*a*. The connector 51 is a circular nut commonly sold on market and a plate screw 56 is screwed thereinto whilst projecting at the enlarged head to be embedded in the piano plate by casting for tighter combination with the piano plate. The other end of the female screw 51*a* is completely closed by a screw 57.

Sections of the connectors 50 and 51 to be exposed outside the piano plate are fully covered by heat insulators 58 such as cast sand in order to prevent annealing of the male and female screws 50*a* and 51*a* during casting. When metal of low melting point is used for casting of the piano plate, use of such heat insulators may be avoided. Casting of the piano plate is carried out in an ordinary manner.

Since the connectors 10 and 41 are formed in one body with the piano plate 1 by placing them as inserts in the mould at casting, no tapping of threaded holes in the connectors is needed after casting, thereby simplifying production of piano plates. The monolithic formation formation of the piano plate 1 with the connectors 10 and 41 provides stable support for the piano plate thanks to the tight combination. Further, the connectors 10 and 41 are very simple in construction and can be arranged at any desired positions on the piano plate. Choice of threaded holes in the connectors has a great freedom in relation to elements to be coupled to the piano plate 1.

Figure 6:
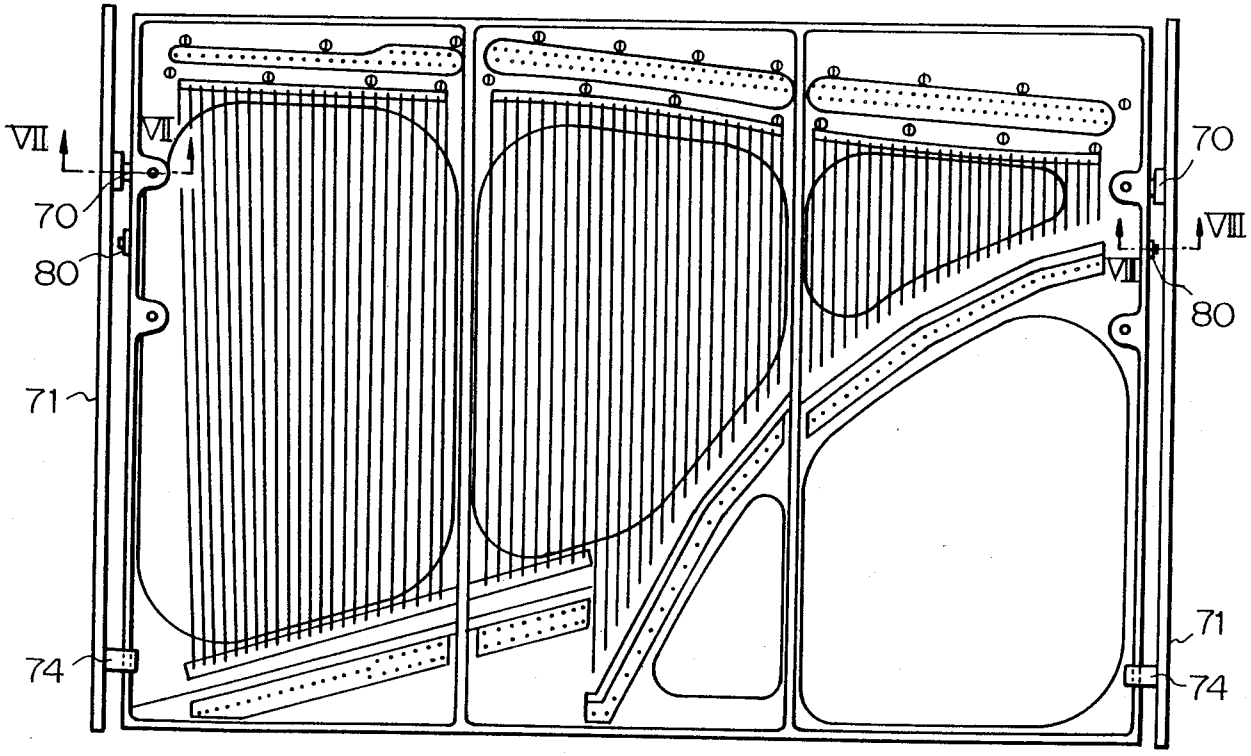
FIG. 6 is a view of another embodiment of the piano plate in accordance with the present invention.
Figure 7:
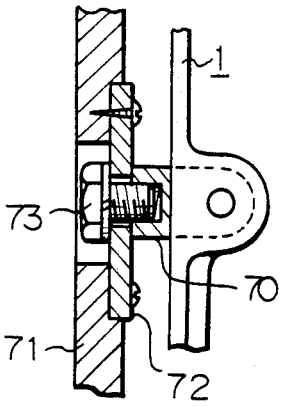
FIG. 7 is a section taken along a line VII—VII in FIG. 6 for showing one combination of the piano plate with a side board.
Figure 8:
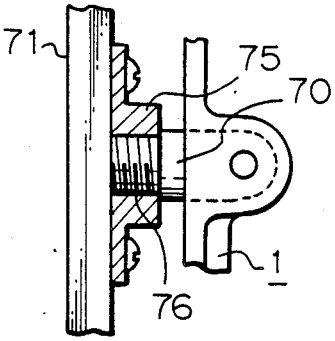
FIG. 8 is a section taken along a line VIII—VIII in FIG. 6 for showing another combination of the piano plate with the side board.

Another embodiment of the piano plate used for an upright piano in accordance with the present invention is shown in FIGS. 6 through 8, in which a piano plate 1 includes connectors 70 formed in one body therewith at positions near the upper ends of its side peripheral edges. Each connector 70 is accompanied with an adapter plate 72 secured thereto by a set bolt 73 and the adapter plate 72 is secured by set screws to the inside face of a side board 71 with the head of the set bolt 73 being received in a proper cutout formed in the side board 71. The lower corners of the piano plate 1 are firmly clamped by holder brackets 74 secured to the inside faces of the side boards 71. The connector 70 may be modified as shown in FIG. 8. In the case of this modification, a fixer piece 75 is secured to the inside face of a side board 71 and one end of the connector 70 is tightly inserted into a hole 76 in the fixer piece 75.

Figure 10:
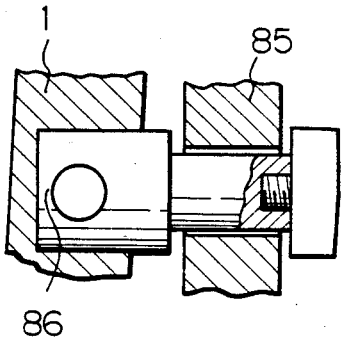
FIG. 10 is a sectional view for showing the junction between the piano plate and a keyboard unit.
Figure 9:
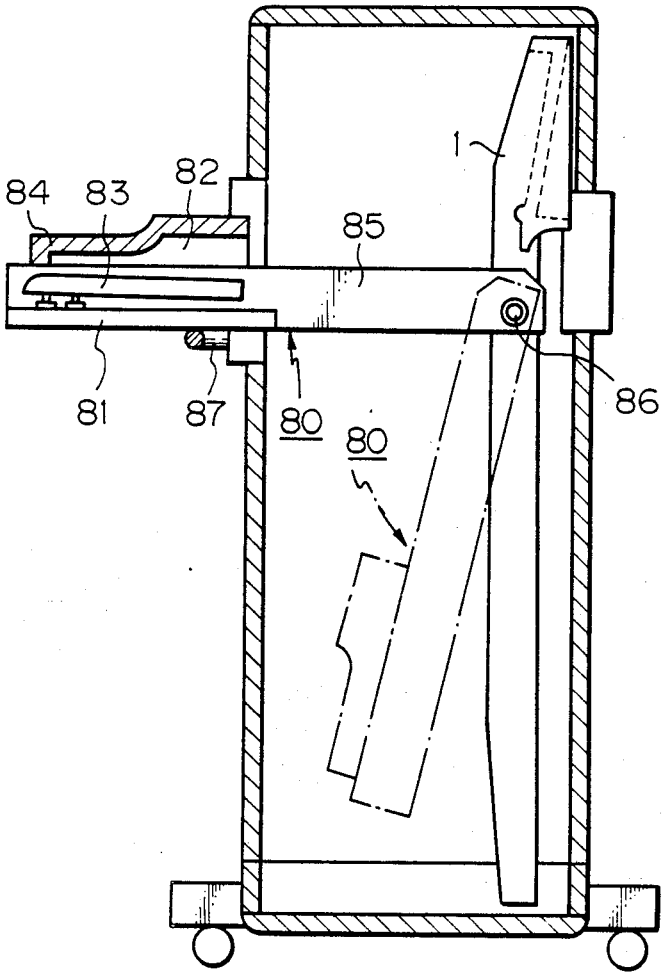
FIG. 9 is a side view, partly in section of the other embodiment of the piano plate in accordance with the present invention in a state encased within the body of an upright piano.

A still further embodiment of the piano plate in accordance with the present invention is illustrated in FIGS. 9 and 10, in which a keyboard unit 80 is swingably mounted to the piano plate 1. More specifically, the keyboard unit 80 includes a key bed 81, side arms 82, a keyboard assembly 83, an fall board 84, a rear extension 85 and their small assemblies. As best seen in FIG. 10, rear extension of the keyboard unit 80 is pivoted to shafts 86 secured on both sides of the piano plate 1. Further, a stopper 87 is coupled to the lower front board of the upright piano. When not used for performance, the keyboard unit 80 as a whole is swing downwards and rearwards about the shaft 86 in order to be fully encased within the body of the upright piano as shown with chain lines in FIG. 9. Whereas for performance, the keyboard unit 80 as a whole is swung upwards and forwards in order to project horizontally from the body of the upright piano and the stopper 87 is set in position to keep the horizontal position of the keyboard unit 80.

In accordance with the present invention, action assemblies are mounted to the piano plate 1 by assistance of the connectors and the action bracket as shown in FIG. 4, keyboard assembly is also mounted to the piano plate 1 by assistance of the keyboard unit as shown in FIG. 9, and the strings to be operated by the keyboard and action assemblies are all arranged on the piano plate. Thanks to such a collected construction, dimensional setting and adjustment of these three closely related elements can be carried out very easily with high accuracy. Since the side boards are directly coupled to the piano plate by assistance of the connectors, there is no longer any need for use of the back post whose warp has posed malign influence on correct generation of musical tones.

I claim:

1. An improved piano plate mounting structure for an upright piano including a frame and at least one action bracket, said piano plate mounting structure comprising a piano plate of cast material mounted to said frame for holding strings under tension, and connectors embedded in said piano plate in the form of inserts during casting of said piano plate and adapted for coupling at least one action bracket of said upright piano to said piano plate.

2. The improved piano plate mounting structure as claimed in claim 1 wherein said upright piano includes a keyboard and a key bed, said key bed coupled to said piano plate by said connectors for supporting said keyboard.

3. The improved piano plate mounting structure as claimed in claim 2 in which said key bed is pivotally coupled to said piano plate.

4. The improved piano plate mounting structure as claimed in claim 1 wherein said upright piano includes side boards, said side boards coupled to said piano plate by said connectors.

5. The improved piano plate mounting structure as claimed in claim 1, further including means for holding said piano plate in position on said upright piano.

6. In an upright piano having a frame for supporting a piano plate mounting structure, said piano plate mounting structure comprising a piano plate constructed of cast material for holding strings under tension, a plurality of connectors in the form of separate inserts embedded in said piano plate during the casting of said piano plate, said connectors integrally forming with said piano plate first and second connecting means, said first connecting means adapted for attaching said piano plate to said frame, and at least one action bracket attached to said second connecting means for supporting a plurality of action assemblies thereon.

* * * * *